US005435046A

United States Patent [19]

Miyauchi et al.

[11] Patent Number: 5,435,046

[45] Date of Patent: Jul. 25, 1995

[54] AUTOMATIC BUCKLING DEVICE

[75] Inventors: Kiyotaka Miyauchi; Tetsuya Hamaue, both of Shiga, Japan

[73] Assignee: Takata Corporation, Tokyo, Japan

[21] Appl. No.: 184,107

[22] Filed: Jan. 21, 1994

[30] Foreign Application Priority Data

Feb. 2, 1993 [JP] Japan ..... 5-015450

[51] Int. Cl.[6] ..... A44B 11/00

[52] U.S. Cl. ..... 24/603; 24/633

[58] Field of Search ..... 24/603, 602, 606, 610, 24/612, 633, 639, 640, 642, 588, 303

[56] References Cited

U.S. PATENT DOCUMENTS 3,146,846 9/1964 Gutshall ..... 24/603
3,311,188 3/1967 Gutshall ..... 24/603
4,126,919 11/1978 Lassche ..... 24/602
5,115,543 5/1992 Fohl ..... 24/633
5,218,746 6/1993 Yamanishi ..... 24/603
5,274,890 1/1994 Shimizu et al. ..... 24/603

*Primary Examiner*—Victor N. Sakran
*Attorney, Agent, or Firm*—Kanesaka & Takeuchi

[57] ABSTRACT

A tongue includes a tongue base which can project therefrom. A solenoid at the forward end of a buckle attracts a tongue face plate. After the tongue base is inserted into the buckle, the tongue base is drawn deep into the buckle by the pawl portion of a hook. A latch plate is engaged with a hole at the forward end of the tongue plate, and a lock plate slides under pegs of a base, thereby latching the tongue base. The lock plate and the hook are advanced and withdrawn by a pinion which is rotated by a stepper motor, and when the pinion is reversely rotated, the tongue base is released from the latched state, and the tongue base is pushed out of the buckle by an ejector, thereby separating the tongue from the buckle.

7 Claims, 12 Drawing Sheets

AUTOMATIC BUCKLING DEVICE

BACKGROUND OF THE INVENTION

1. Field of the Invention

The present invention relates to an improvement of a mechanism for connecting a tongue and a buckle of a seat belt apparatus which is installed in vehicles or the like and, more particularly, to an automatic buckling device for automatically connecting the tongue with the buckle when the tongue is brought close to the buckle.

2. Description of the Related Art

When an occupant uses a seat belt apparatus installed in an automobile, a tongue attached to a seat belt is manually inserted into a buckle.

Since the buckle is disposed on one side of a seat, the occupant must twist the upper half of his body in an uncomfortable posture in order to insert the tongue into the buckle.

OBJECT AND SUMMARY OF THE INVENTION

Accordingly, it is an object of the present invention to eliminate the above-described problems in the related art and to provide an automatic buckling device which enables a tongue to automatically insert into a buckle by utilizing a motor or the like.

To achieve this aim, in a first aspect of the present invention, there is provided an automatic buckling device having a mechanism of drawing a tongue base into a buckle by a hook which is driven by a motor or the like, retaining the tongue base by a latch plate, and checking the withdrawal of the latch plate by a lock plate, thereby latch-holding the tongue base.

An automatic buckling device provided in a second aspect of the present invention adopts a rack-and-pinion mechanism as a driving mechanism, and a hook is rocked and advanced or withdrawn with the advance or withdrawal of a rack of the rack-and-pinion mechanism. In an automatic buckling device provided in a third aspect of the present invention, the lock plate is locked or unlocked with the advance or withdrawal of the rack. In an automatic buckling device provided in a fourth aspect of the present invention, the tongue is attracted to a solenoid.

In an automatic buckling device of the present invention, when the tongue base is inserted into the entrance portion of the buckle, the hook is engaged with the hole of the tongue base, so that the hook is withdrawn. By this operation, the tongue base is drawn into the admission space within the buckle. When the tongue base advances in the admission space, the tongue base pushes an ejector inward. When the tongue base advances deep into the admission space, the latch plate engages a hole provided in the tongue base.

The lock plate is then moved to the back side of the latch plate and is retained by a stopper portion. The withdrawal of the latch plate from the hole of the tongue base is checked in this way, and the latched state of the tongue base is maintained.

In order to separate the tongue from the buckle, the lock plate is moved from the back side of the latch plate by the driving mechanism. This movement allows the latch plate to withdraw from the admission space, and the tongue base is pushed out of the buckle.

In an automatic buckling device provided in the second aspect of the present invention, the hook is advanced or withdrawn and rocked by the motor through the rack-and-pinion mechanism, thereby drawing the tongue base into the buckle.

In an automatic buckling device provided in the third aspect of the present invention, the lock plate is advanced or withdrawn with the advance or withdrawal of the rack, thereby latching the tongue base or releasing the tongue base from the latched state.

In an automatic buckling device provided in the fourth aspect of the present invention, a tongue face plate is magnetically attracted to a solenoid, so that the forward end surface of the tongue is attracted to the buckle.

The above and other objects, features and advantages of the present invention Will become clear from the following description of the preferred embodiment thereof, taken in conjunction with the accompanying drawings.

DESCRIPTION OF THE PREFERRED EMBODIMENT

Figure 1:
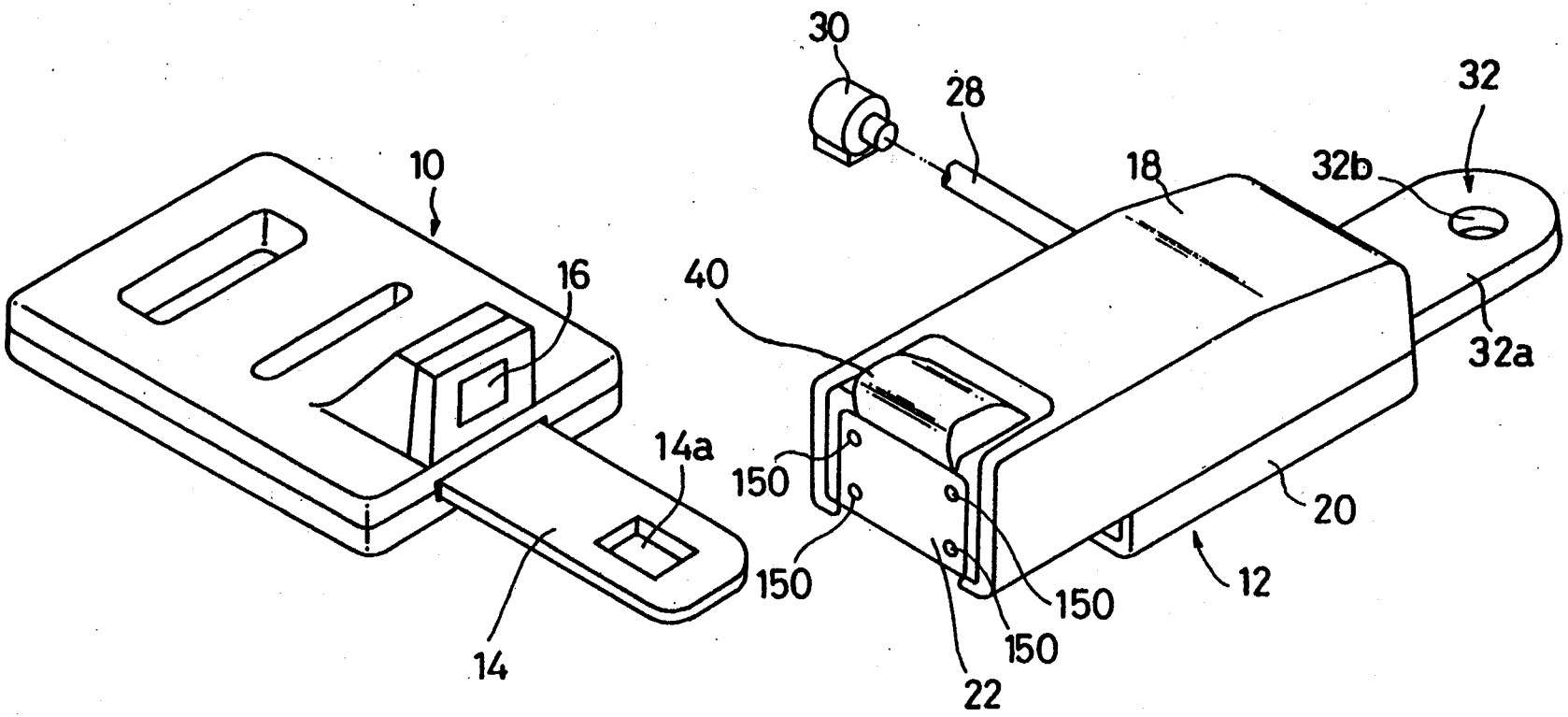
FIG. 1 is a perspective external view of the entire part of an embodiment of an automatic buckling device according to the present invention.
Figure 2:
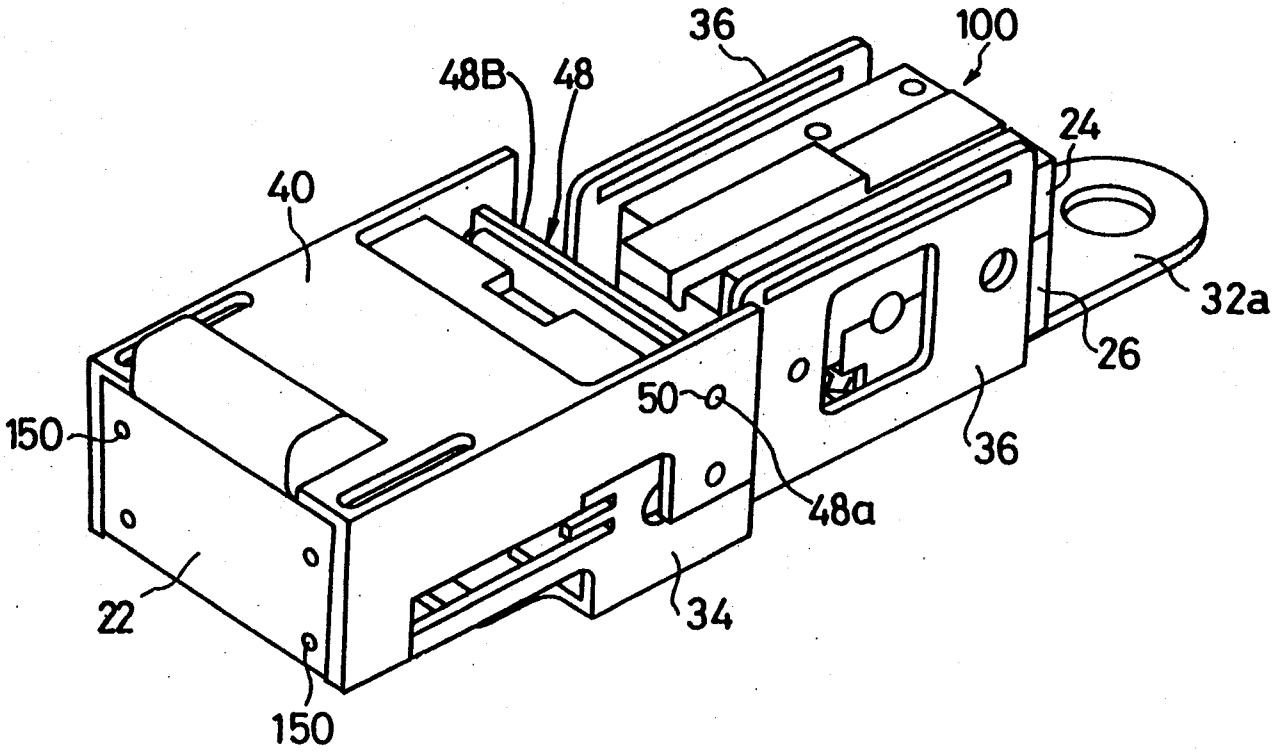
FIG. 2 is a perspective view of the interior of the buckle in the embodiment shown in FIG. 1.
Figure 3:
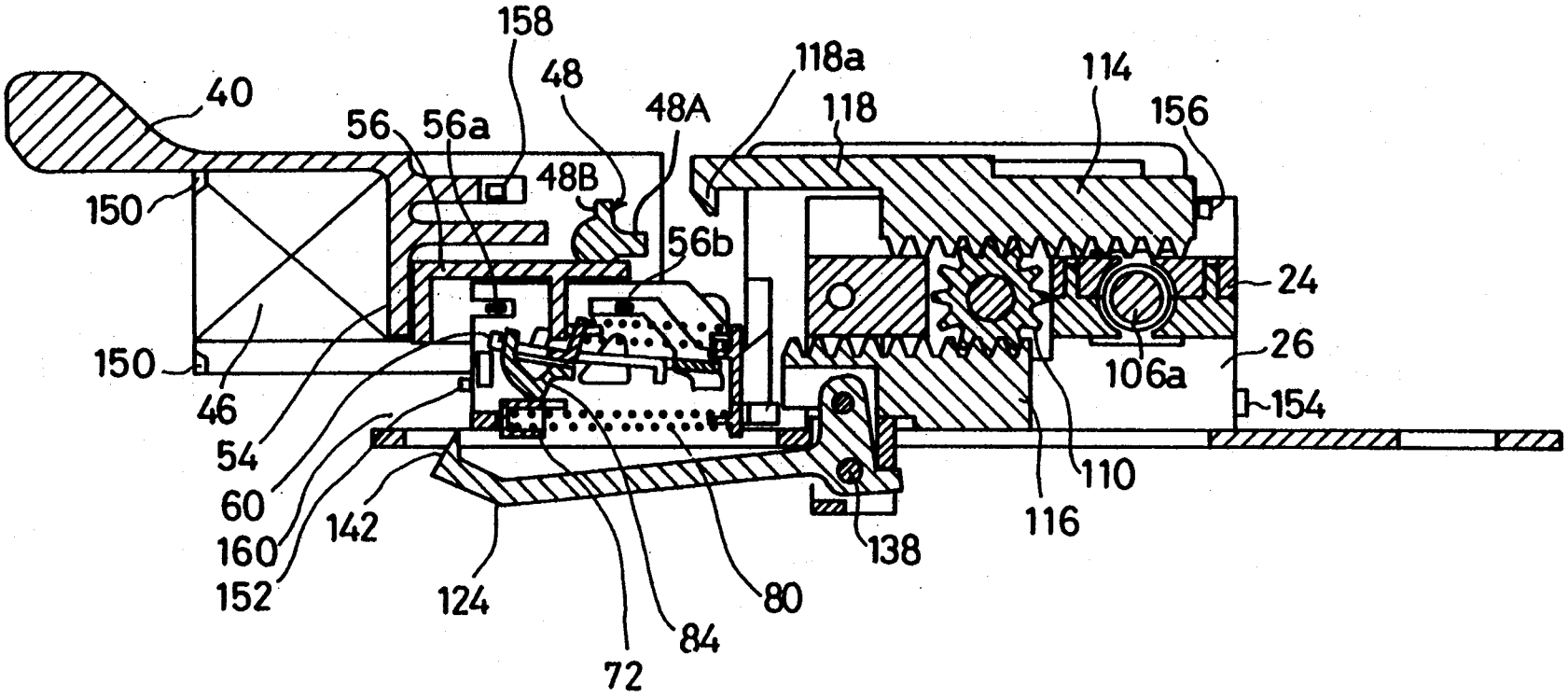
FIG. 3 is a sectional view of the buckle in the embodiment shown in FIG. 1.
Figure 9:
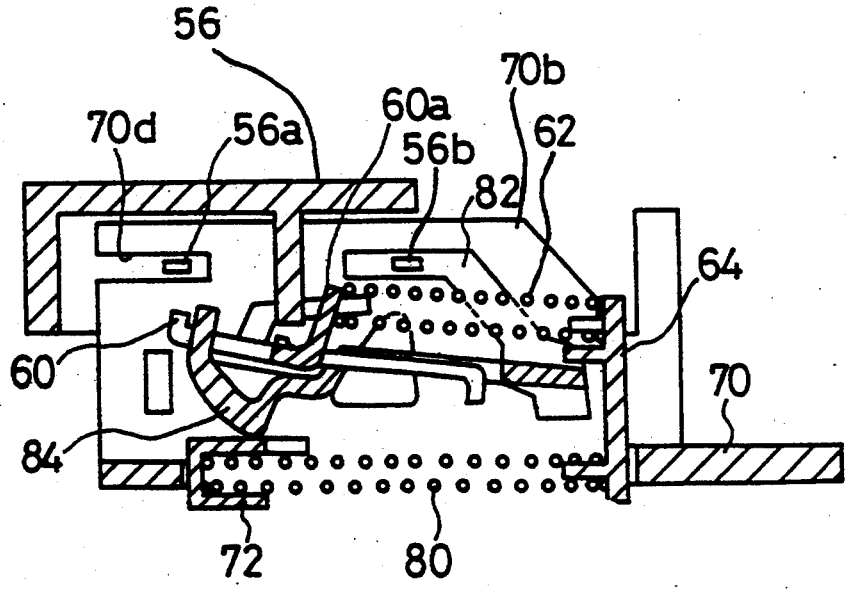
FIG. 9 is a sectional view of the buckle shown in FIG. 8 taken along the line 9—9.
Figure 10:
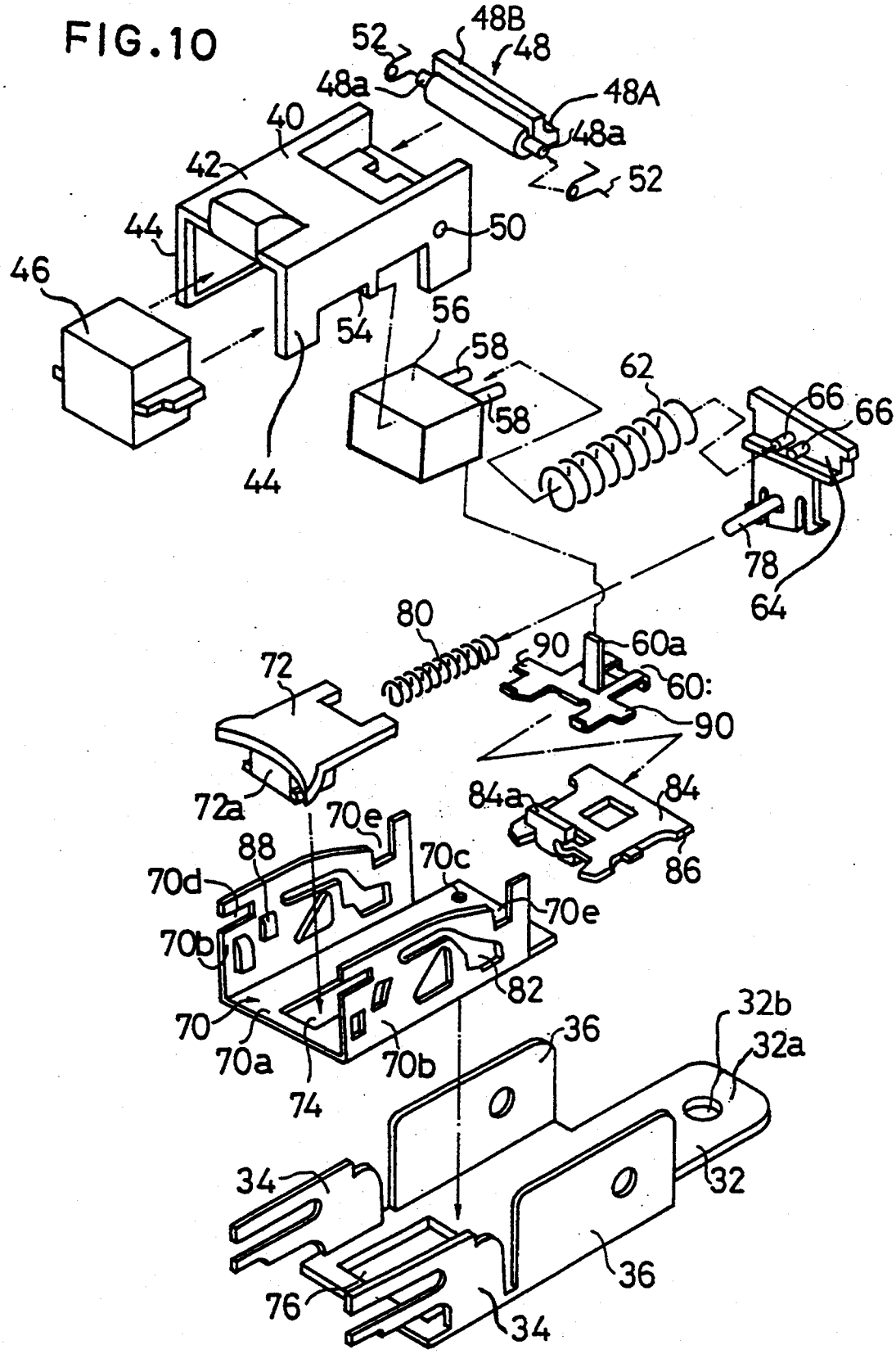
FIG. 10 is a further exploded perspective view of the main part of the buckle shown in FIG. 3.
Figure 11:
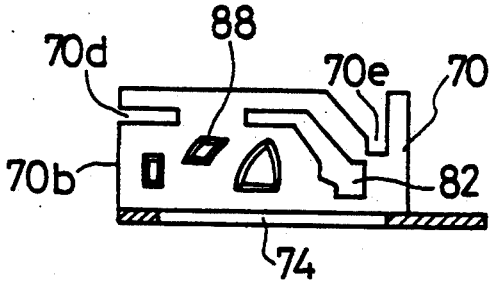
FIG. 11 is a sectional view of the base of the buckle shown in FIG. 4.
Figure 12:
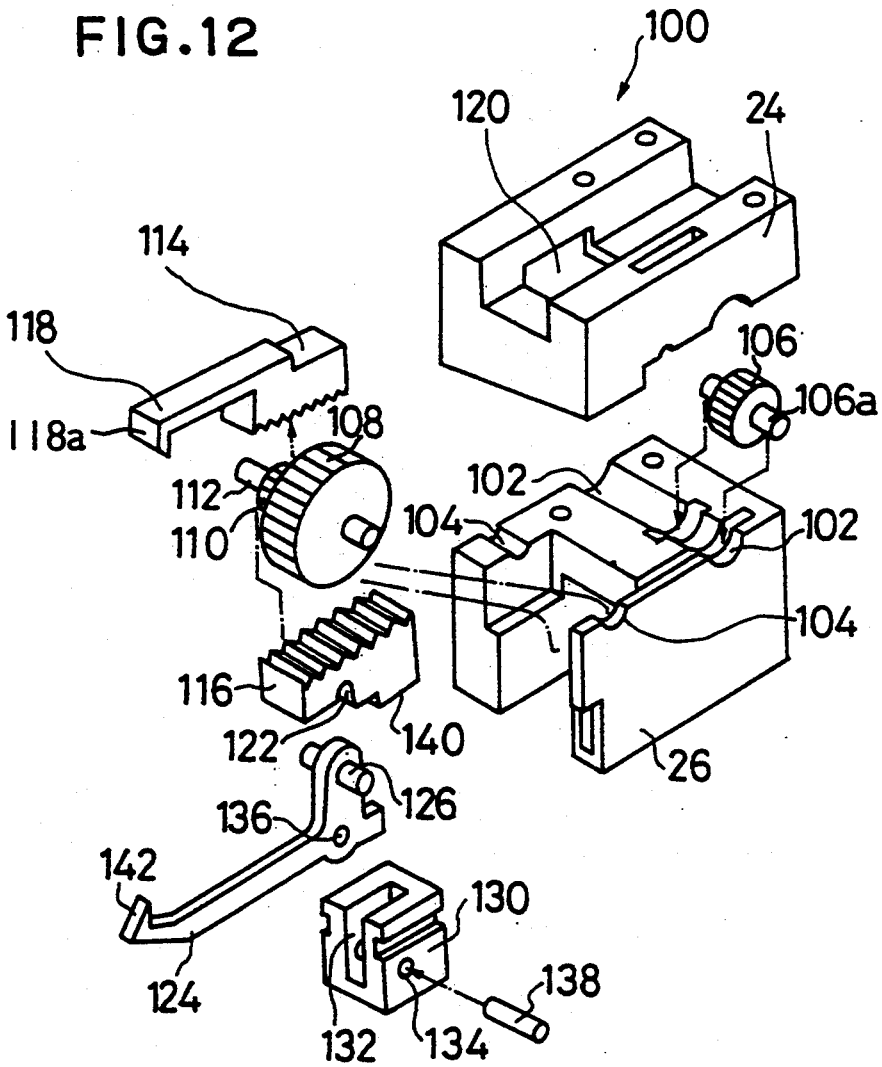
FIG. 12 is an exploded perspective view of the rack-and-pinion mechanism as the driving mechanism in the embodiment shown in FIG. 1.
Figure 13:
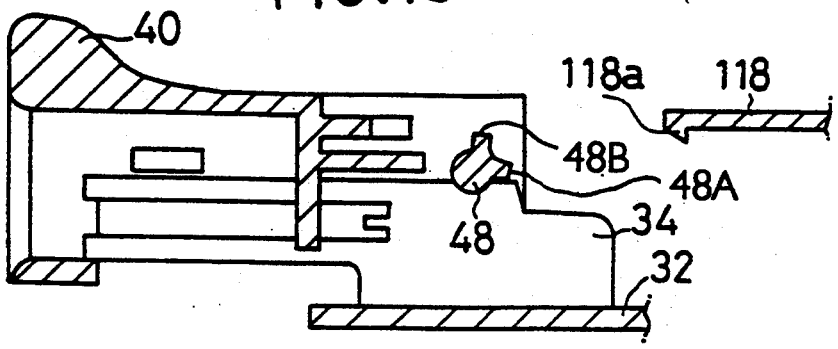
FIGS. 13 to 22 are schematic sectional views of the main part of the buckle shown in FIG. 3, explaining the operations of latching the tongue base and releasing the tongue base from the latched state.

An embodiment of an automatic buckling device according to the present invention will be explained hereinunder with reference to the accompanying drawings. FIG. 1 is a perspective view of an embodiment of an automatic buckling device according to the present invention; FIG. 2 is a perspective view of the interior of the buckle in the embodiment; FIG. 3 is a sectional view of the buckle; FIGS. 4 to 8 are exploded perspective views of the main part of the buckle; FIG. 9 is a sectional view of the buckle shown in FIG. 8, taken along the line 9—9; FIGS. 10 and 12 and FIG. 11 are exploded perspective views and a sectional view, respectively, of the main part of the buckle; and FIGS. 13 to 22 are sectional views of the main part of the buckle, explaining the operation of the automatic buckling device.

Referring first to FIG. 1, an embodiment of an automatic buckling device according to the present invention is composed of a tongue 10 and a buckle 12. The forward end of a tongue base 14 projects from the forward end surface of the tongue 10. The tongue base 14 is drawn into the buckle 12 and latched by a latching mechanism. A frame-shaped metal tongue face plate 16 is provided on the forward end surface of the tongue 10.

The internal structure of the buckle 12 will first be explained with reference to FIGS. 2 and 5 to 11. The outer shell of the buckle 12 is composed of a lower buckle cover 20 and an upper buckle cover 18.

FIG. 2 shows the buckle 12 with the covers 18, 20 removed therefrom. As shown in FIG. 2, a solenoid 22 is disposed at the forward end of the buckle 12, and a driving mechanism 100 is accommodated in housings 24, 26 at the rear portion of the buckle 12. A pinion is inserted into the housings 24, 26, as will be described later. The pinion is connected with a wire 28 which projects sideways from the housings 24, 26 so that the pinion can be rotated by a stepper motor 30, as shown in FIG. 1. The reference numeral 32 represents a base bracket having first side walls 34 and second side walls 36, as shown in FIG. 10. The housings 24, 26 are disposed between the second side walls 36. The rear portion 32*a* of the base bracket 32 extends rearward of the buckle covers 18, 20, and can be fixed to a vehicle body by a bolt inserted into a bolt hole 32*b*.

A press button 40 is provided between the first side walls 34. The press button 40 has an inverted U-shaped section having an upper surface portion 42 and side surface portions 44, as shown in detail in FIG. 10. A solenoid 46 is inserted into the forward end portion of the press button 40 in a fixed state. A rotary claw 48 is rotatably supported by the rear end portion of the press button 40 through a shaft. The rotary claw 48 has an L-shaped section provided with two flaps 48A, 48B. Shaft ends 48*a* projected from both ends of the rotary claw 48 are inserted into holes 50 formed in the side surfaces 44 of the press button 40, so that the rotary claw 48 is freely rotatable around the shaft. A spring 52 is placed over each of the shaft ends 48*a*, thereby urging the rotary claw 48 clockwise seen in FIG. 10.

As shown in FIG. 10, a protruding piece 54 protrudes downward from the central portion of the press button 40, and a sub press button 56 is attached to the back surface of the protruding piece 54. A pair of pins 58 provided on the back surface of the sub press button 56 project toward the depth of the buckle 12, and a mast portion 60*a* erected on a lock plate 60 is inserted between the pins 58. One end of a latch spring 62 is placed over the pins 58, and the other end of the latch spring 62 is placed over pins 66 projecting from a back holder 64 toward the entrance of the buckle 12.

A base 70 is fixed between the first side walls 34 of the base bracket 32. The base 70, which is composed of a bottom surface 70*a* and side walls 70*b*, is fixed to the base bracket 32 by bolts (not shown) inserted into bolt holes 70*c* in the bottom surface 70*a*. The bottom surface 70*a* of the base 70 is provided with a guide slit 74 for receiving a protrusion 72*a* which is provided on the under surface of an ejector 72.

An opening 76 is provided in the base bracket 32 at the position which faces the guide slit 74. The back holder 64 is inserted into the guide slit 74 and the opening 76, and fixed to the base bracket 32. A pin 78 is projected forward from the lower portion of the back holder 64, and an ejector spring 80 is placed over the pin 78 between the ejector 72 and the back holder 64.

An opening 82 is provided in both side walls 70*b* of the base 70, and the shaft portion 86 of a latch plate 84 is inserted into the opening 82 so as to vertically move the head portion 84*a* of the latch plate 84.

Pegs 88 protruding to the inside of the base 70 are provided on the side walls 70*b*, and the lock plate 60 is provided with projecting portions 90 which can slide under the pegs 88. In other words, in this embodiment, the pegs 88 function as a stopper for checking the withdrawal of the lock plate 60.

The steps of assembling the base 70, the latch plate 84, the lock plate 60, the ejector 72, the back holder 64, the sub press button 56, the latch spring 62, etc. will now be explained with reference to FIGS. 4 to 8.

Figure 4:
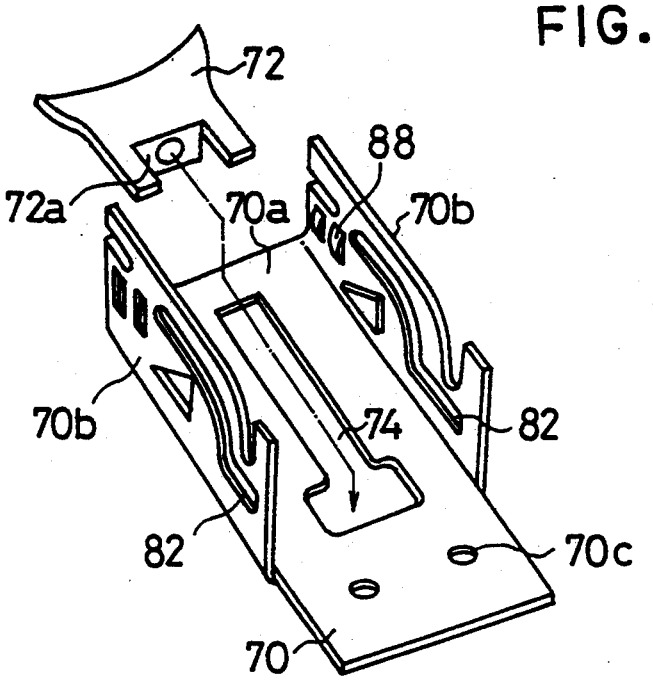
FIG. 4 is an exploded perspective view of the main part of the buckle shown in FIG. 3.
Figure 5:
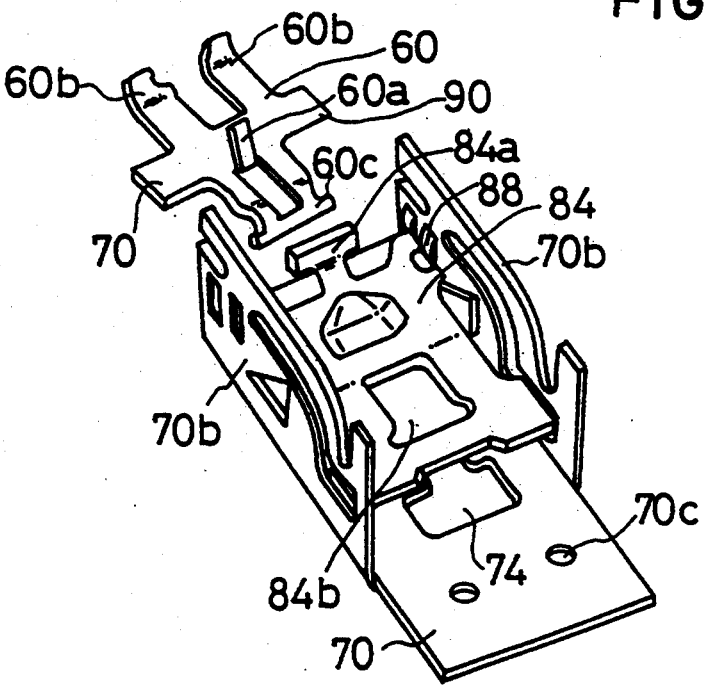
FIG. 5 is another exploded perspective view of the main part of the buckle shown in FIG. 3.

As shown in FIG. 4, the ejector 72 is first engaged with the guide slit 74 of the base 70. The latch plate 84 is then disposed over the ejector 72, and the lock plate 60 is disposed on the latch plate 84, as shown in FIG. 5. The back holder 64 is next inserted into the guide slit 74 at the rear portion, and the ejector spring 80 is placed over the pin 78 of the back holder 64 between the ejector 72 and the back holder 64, as shown in FIG. 6.

Figure 6:
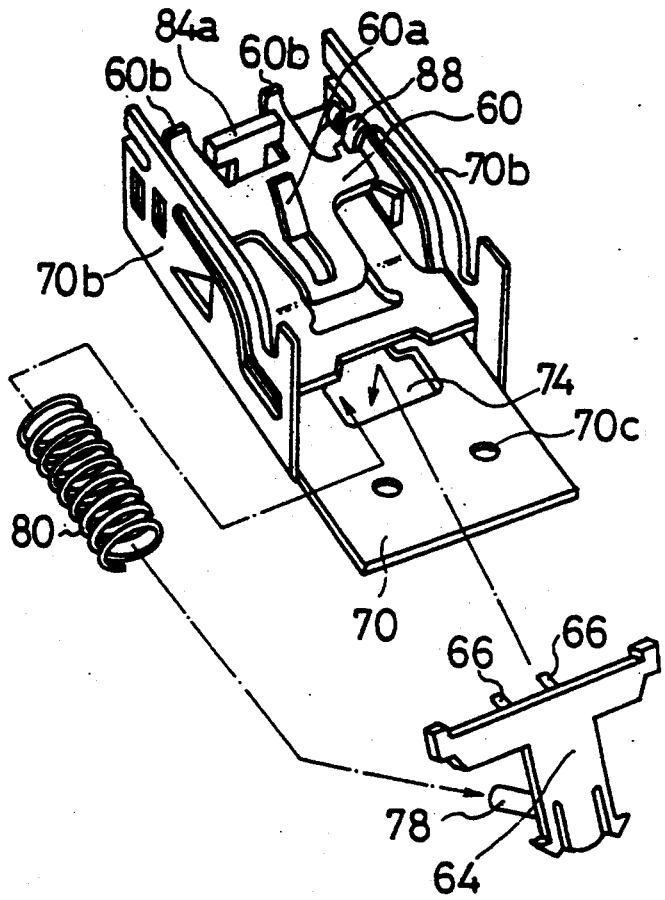
FIG. 6 is still another exploded perspective view of the main part of the buckle shown in FIG. 3.

When the lock plate 60 is placed on the latch plate 84, the head portion 84*a* is of the latch plate 84 interposed between a pair of projections 60*b* at the forward end thereof, as shown in FIG. 6. The turn-down portion 60*c* of the lock plate 60 hooks the forward edge of the opening 84*b* provided in the latch plate 84. In this way, the lock plate 60 and the latch plate 84 are combined with each other as one unit.

Figure 7:
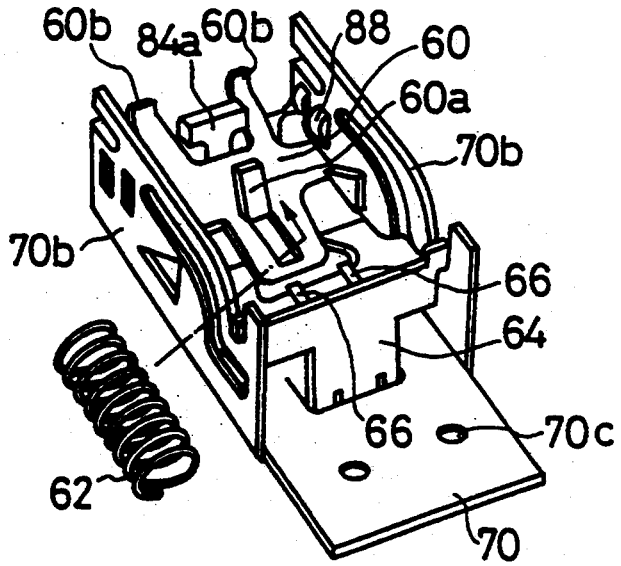
FIG. 7 is a further exploded perspective view of the main part of the buckle shown in FIG. 3.
Figure 8:
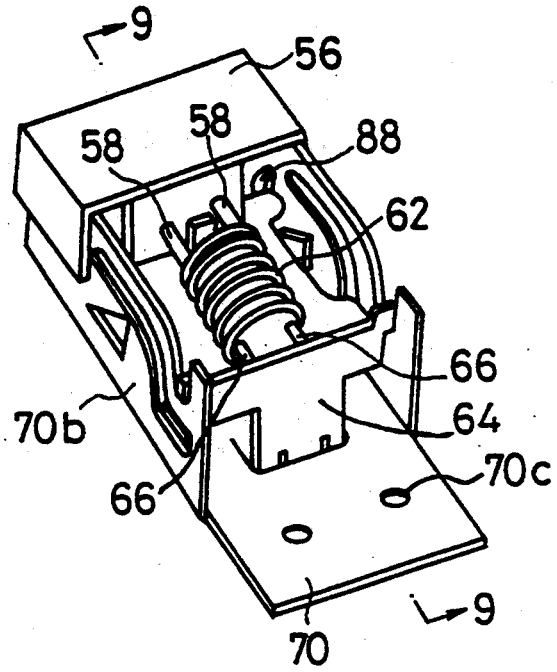
FIG. 8 is a perspective view of the main part of the buckle shown in FIG. 3.

Thereafter, the sub press button 56 is placed over the base 70 in such a manner that the mast portion 60*a* of the lock plate 60 is interposed between the pins 58, as shown in FIG. 8. As shown in FIGS. 7 to 9, the latch spring 62 is fitted over the pins 58 and the pins 66 of the back holder 64. FIG. 9 is a sectional view of the assembly shown in FIG. 8, taken along the line 8—8.

As is clear from FIGS. 9 and 10, notched portions 70*d* are provided on the forward ends of the side walls 70*b* of the base 70. Protuberances 56*a* which engage the notched portions 70*d*, and protuberances 56*b* which engage the opening 82 of the base 70 are provided on the sub press button 56, as shown in FIG. 9. By the engagements between the protuberances 56*a* and the notched portions 70*d* and between the protuberances 56*b* and the opening 82, the sub press button 56 is mounted over the base so as to be slidable forward and backward.

The driving mechanism 100 having the housings 24 and 26 will now be explained with reference to FIGS. 3 and 12. Bearing portions 102 and 104 are provided on the top surface of the housing 26, and the shaft 106*a* of a first pinion 106 is supported by the bearing portions 102. A second pinion 108 and a third pinion 110 are united into one body by a common shaft 112 which is supported by the bearing portions 104. The second pinion 108 meshes the first pinion 106, and the third pinion 110 meshes a locking rack 114 and a drawing rack 116.

A rod 118 is extended forward from the locking rack 14, and a retainer claw 118*a* which is engageable with the rotary claw 48 is provided at the forward end of the rod 118. The housing 24 is placed on the housing 26 so as to cover the pinions 106, 108, 110 and the locking rack 114. An opening 120 is provided in the housing 24, and the rod 118 of the locking rack 114 is passed through the opening 120 so as to project forward from the housing 24. The locking rack 114 is slidable along the inner surfaces of the housing 24. The drawing rack 116 is slidable along the inner surfaces of the housing 26.

A bearing portion 122 is provided on the under surface of the drawing rack 116, and a shaft 126 provided at the rear portion of a hook 124 engages the bearing portion 122. The rear end portion of the hook 124 is inserted into a recessed portion 132 of a slider 130, and a pin 138 is passed through through holes 134 and 136 provided in the slider 130 and the hook 124, respectively. In this manner, the hook 124 is rotatably attached to the slider 130.

The under surface of the drawing rack 116 is in contact with the upper surface of the slider 130. A protruding portion 140 which is engageable with the rear surface of the slider 130 is provided on the under surface of the drawing rack 116.

When the drawing rack 116 advances, after the shaft 126 slightly advances, the protruding portion 140 of the drawing rack 116 comes into contact with the rear surface of the slider 130. When the drawing rack 116 advances relative to the slider 130, the shaft 126 also moves forward, so that the hook 124 is rotated around the pin 138 and a pawl portion 142 at the forward end of the hook 124 is pressed downward.

On the other hand, when the drawing rack 116 moves backward relative to the slider 130, the shaft 126 also moves slightly backward, so that the hook 124 is rotated in such a manner that the pawl portion 142 moves upward.

As shown in FIG. 1, a sensor 150 for detecting the approach of the tongue 10 is provided on the forward end surface of the buckle 12. A limit switch 152 is provided at the entrance portion to an admission space 160 of the buckle 12 into which the tongue base 14 is admitted, as shown in FIG. 3. A limit switch 154 for detecting the withdrawal of the drawing rack 116 and a limit switch 156 for detecting the withdrawal of the locking rack 114 are provided at the rear portion of the second side wall 36 of the base bracket 32. A limit switch 158 for detecting the advance of the rod 118 is provided on the press button 40.

Figure 16:
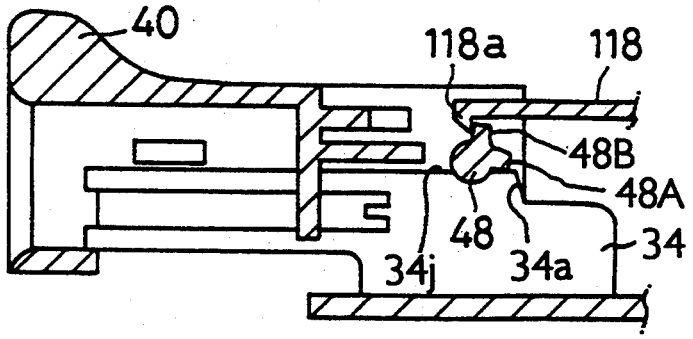
Figure 17:
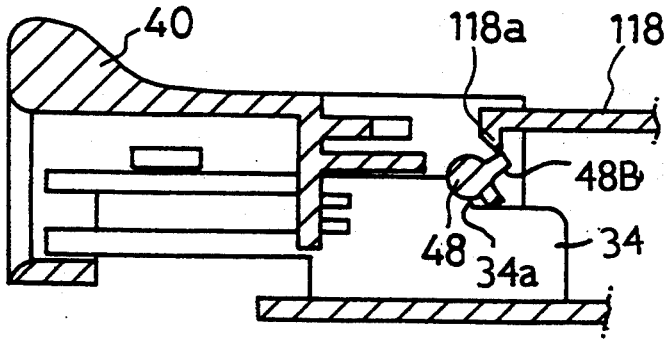
Figure 18:
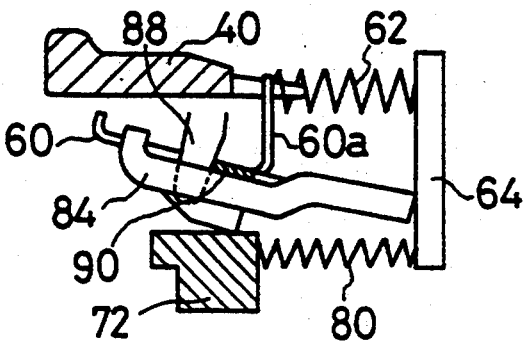

The operation of the automatic buckling apparatus having the above-described structure will be explained in the following with reference to FIG. 3 and FIGS. 13 to 22. Before the tongue 10 is inserted into the buckle 12, the drawing rack 116 is at the limit of advance and the locking rack 114 is at the limit of withdrawal, as shown in FIG. 3. As shown in FIG. 18, the ejector 72 is at the limit of advance.

When the tongue 10 is brought close to the buckle 12 in this state, the sensor 150 detects the presence of the tongue 10, and the solenoid 46 is excited. The tongue face plate 16 is then attracted to the solenoid 46 and the tongue 10 is attracted to the buckle 12, so that the tongue base 14 enters the admission space 160.

When the tongue base 14 advances to the position which allows a hole **14*a* at the forward end of the tongue base 14 to engage the pawl portion 142 of the hook 124, the limit switch 152 detects the presence of the tongue base 14 and rotates the stepper motor 30 in the normal direction. By this operation, the drawing rack 116 begins to withdraw, and the forward end of the hook 124 is first moved upward seen in FIG. 3. The pawl portion 142 of the hook 124 then enters the admission space 160 and engages the hole 14*a* of the tongue base 14. When the drawing rack 116 further withdraws, the hook 124 is drawn by the rack 116, so that the tongue base 14 is drawn deep into the admission space 160**.

Figure 19:
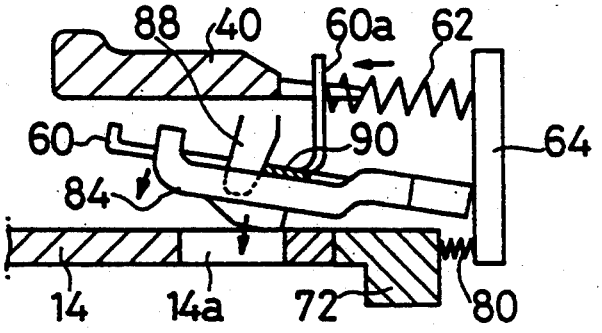
Figure 20:
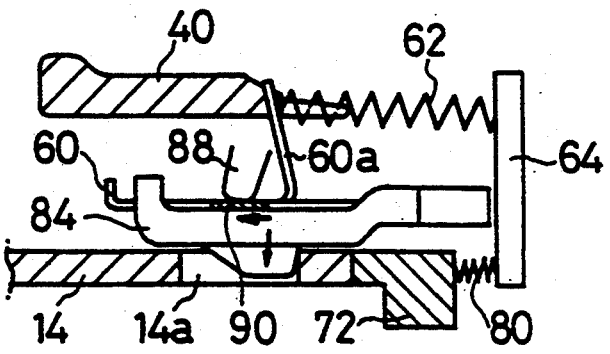

As the tongue base 14 advances deep into the admission space 160, the ejector 72 is pushed backward by the tongue base 14. When the hole **14*a* in the tongue base 14 enters the admission space 160 deep enough, the latch plate 84 rotates downward seen in FIG. 3 and enters the hole 14*a*, as shown in FIGS. 19 and 20. The lock plate 60 also rotates downward seen in FIG. 3 with the rotation of the latch plate 84. When the lock plate 60 rotates downward, the projecting portions 90 slide under the pegs 88, as shown in FIG. 20. To state this more concretely, when the lock plate 60 is in the state shown in FIG. 3, the projecting portions 90 is in contact with the rear portions of the pegs 88, but when the lock plate 60, which is urged forward by the latch spring 62, rotates downward, the lock plate 60 advances and the projecting portions 90 slide under the pegs 88. The engagement between the projecting portions 90 and the pegs 88 checks the upward movement of the lock plate 60 seen in FIG. 3. As a result, the latch plate 84 remains engaged with the opening 14*a*, thereby latching the tongue base 14**.

Figure 14:
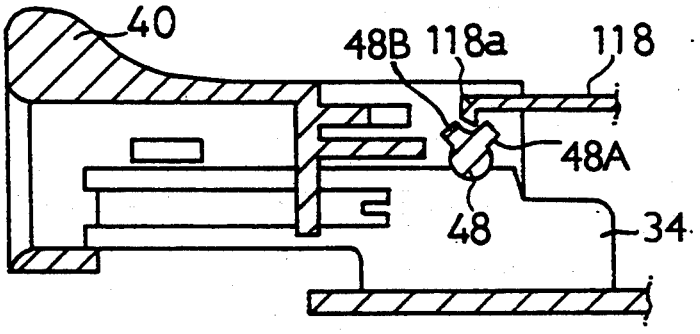
Figure 15:
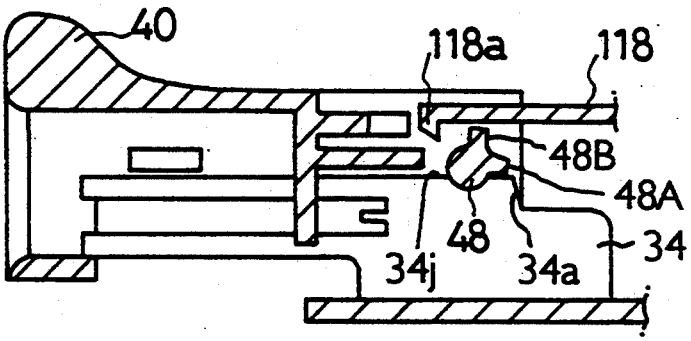

When the drawing rack 116 and the hook 124 are withdrawn by the normal rotation of the stepper motor 30, the locking rack 114 and the rod 118 advance in their place. When the rod 118 advances, the retainer claw **118*a* at the forward end comes into contact with the flap 48B of the rotary claw 48, as shown in FIG. 14. However, since the rotary claw 48 is rotatable counterclockwise seen in FIG. 14, the rod 118 continues to advance to its limit, as shown in FIG. 15**, and stops at the limit.

In order to release the tongue base 14 from the latched state, a switch (not shown) is operated so as to reversely rotate the stepper motor 30. With this operation, the rod 118 withdraws, and the retainer claw **118*a* engages the flap 48B of the rotary claw 48, as shown in FIG. 16. In this state, the flap 48A of the rotary claw 48 engages the upper surfaces 34*j* of the first side walls 34 of the base bracket 32, so that the clockwise rotation seen in FIG. 16 is checked. Therefore, the retainer claw 118*a* remains engaged with the flap 48B of the rotary claw 48, so that the rotary claw 48 is withdrawn in the state of being engaged with the withdrawing rod 118. In other words, the rotary claw 48 moves rightward seen in FIG. 16**.

When the rod 118 withdraws by a predetermined distance, the rotary claw 48 reaches recessed portions **34*a* of the first side walls 34 of the base bracket 32. Then the rotary claw 48 rotates clockwise, as shown in FIG. 17, and the engagement between the retainer claw 118 and the flap 48B of the rotary claw 48 is broken. With the withdrawal of the rod 118, the press button 40 with the sub press button 56 and the rotary claw 48 attached thereto is advanced by the urging force of the latch spring 62**.

Figure 21:
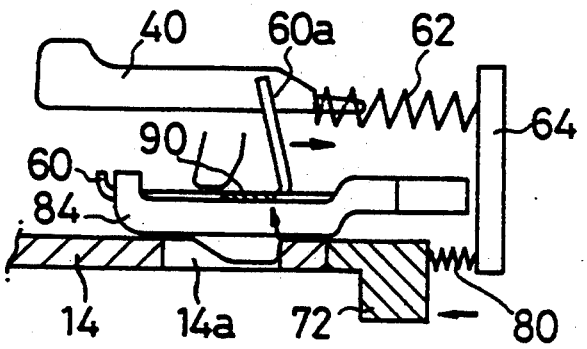
Figure 22:
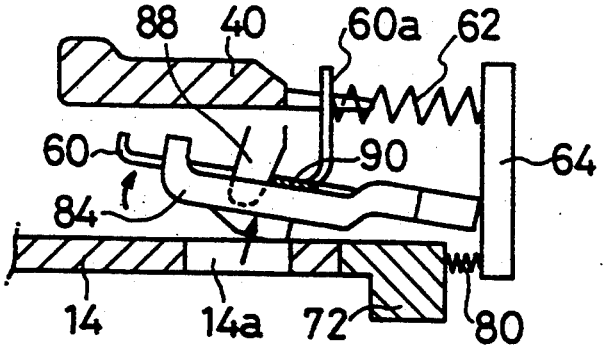

When the press button 40 is withdrawn with the withdrawal of the rod 118, the sub press button 56 also moves backward. Since the sub press button 56 is engaged with the mast portion **60*a* of the lock plate 60, the lock plate 60 also withdraws with the withdrawal of the sub press button 56. In other words, the lock plate 60 withdraws with the withdrawal of the locking rack 114. As shown in FIG. 21, when the lock plate 60 withdraws, the projecting portions 90 withdraw from the underside of the pegs 88, thereby allowing the lock plate 60 to rotate upward. Since the tongue base 14 is urged by the ejector spring 80 through the ejector 72 in the direction of withdrawal (in the direction in which the tongue base 14 is withdrawn from the buckle 12), when the projecting portions 90 of the lock plate 60 slide away from the underside of the pegs 88, the tongue base 14 presses the lock plate 60 and the latch plate 84 upward so as to withdraw the latch plate 84 from the hole 14***a*, as shown in FIG. 22. By the urging force of the ejector spring 80, the tongue base 14 is pushed away from the admission space 160, so that the tongue 10 is separated from the buckle 12. As a result, the buckle 12 returns to the state shown in FIG. 3, 13 and 18.

Although the separating operation is performed by reversing the stepper motor 30, the press button 40 may be pressed instead in this embodiment. When the press button 40 is manually pressed in the state shown in FIG. 15, the sub press button 56 and the lock plate 60 can be manually withdrawn. As a result, the projecting portions 90 of the lock plate 60 withdraw from the underside of the pegs 88, thereby allowing the lock plate 60 to rotate upward seen in FIG. 3. Therefore, by the urging force of the ejector spring 80, the tongue base 14 is withdrawn from the admission space 160 while pressing the latch plate 84 and the lock plate 60 upward, as shown in FIG. 22.

As described above, according to the embodiment of an automatic buckling device of the present invention, when the forward portion of the tongue is inserted into the buckle, the tongue base is automatically drawn into the buckle, thereby assuming the latched state. Accordingly, the occupant is not required to twist the upper half of his body in order to insert the tongue into the buckle. In other words, the buckling operation of the seat belt apparatus is facilitated. In addition, it is possible to separate the tongue from the buckle only by operating the switch. That is, the unbuckling operation of the seat belt apparatus is also facilitated.

More specifically, the connection of the tongue and the buckle is facilitated, because the hook is advanced and withdrawn by the rotation of the pinion, and the tongue is attracted to the buckle by magnetic force.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An automatic buckling device comprising:

a tongue having a plate-like tongue base projecting from a forward end of said tongue and a hole formed at a forward end portion of the tongue base; and a buckle which draws said tongue base of said tongue into an interior of said buckle so as to lock said tongue in said buckle and maintain connection therebetween;

said buckle including:

an admission space into which said tongue base is inserted;

a hook formed at one side of the admission space and having a claw portion;

a latch plate which is engageable with said hole of said tongue base;

a lock plate having a notched portion and disposed on said latch plate in such a manner that said latch plate is disposed into said admission space and held in a state of being latched by the notched portion provided on said lock plate;

an ejector provided in said admission space so as to be advanced and withdrawn in a direction in which said tongue base is advanced and withdrawn;

an ejector spring for urging said ejector in a direction in which said tongue base is pushed back;

a sensor for detecting entrance of said tongue base;

a stopper portion which comes into contact with said lock plate when said lock plate assumes a latching state so as to prevent withdrawal of said latch plate in a direction in which said latch plate is released from the latched state; and a driving mechanism for driving said hook and said lock plate in accordance with a detection signal of said sensor, said driving mechanism including; a motor; a pinion rotated by the motor; a locking rack and a hook drawing rack which mesh said pinion and are movable in the direction in which said tongue base advances and withdraws; interlocking means for interlocking said locking rack and said hook drawing rack; and a slider which is freely movable in the direction of advance and withdrawal of said tongue base, and which pivotally supports a longitudinal middle portion of said hook so as to advance said hook and withdraw said claw portion of said hook from said admission space when said hook drawing rack advances toward the entrance of said buckle, while causing said claw portion of said hook to enter .said admission space and withdrawing said hook when said hook drawing rack withdraws, said lock being moved into said admission space and retained in said hole of said tongue base by said driving mechanism when said tongue base advances in said admission space.

2. An automatic buckling device according to claim 1, wherein said hook extends towards the entrance of said buckle, and a lead end of said hook is supported by said driving mechanism through a shaft.

3. An automatic buckling device according to claim 2, wherein said buckle is provided at the forward end thereof with a sensor for detecting approach of said tongue and a solenoid which is excited in accordance with a detection signal of said sensor, and said tongue is provided on a forward end surface thereof with one of a metal plate or a magnet which is magnetically attracted to said solenoid.

4. An automatic buckling device according to claim 2, wherein said interlocking means includes:

a rod extending toward said tongue from said locking rack;

a retainer claw provided at the forward end of said rod;

a press button which is freely movable in the direction of advance and withdrawal of said tongue base, and which engages said lock plate so as to move said lock plate when said press button moves in the direction of insertion of said tongue base; and a rotary claw which is rotatably supported by said press button and which is engageable with said retainer claw;

said rotary claw rotating in the direction which permits said retainer claw to pass when said rod advances toward said tongue and said retainer claw comes into contact with said rotary claw, engaging said retainer claw so as to withdraw said press button when said rod withdraws and said retainer claw comes into contact with said rotary claw, and rotating in the direction which breaks the engagement between said rotary claw and said retainer claw so as to permit the withdrawal of said rod when said press button withdraws by a predetermined distance.

5. An automatic buckling device according to claim 3, wherein said buckle is provided at the forward end thereof with a sensor for detecting approach of said tongue and a solenoid which is excited in accordance with a detection signal of said sensor, and said tongue is provided on a forward end surface thereof with one of a metal plate and a magnet which is magnetically attracted to said solenoid.

6. An automatic buckling device according to claim 5, wherein, after said solenoid at the forward end of said buckle attracts said tongue and said tongue base is inserted into said buckle, said tongue base is drawn deep into said buckle by said pawl portion of said hook, said latch plate is engaged with said hole, and said lock plate slides under said stopper portion, thereby latching said tongue base; and said lock plate and said hook are advanced and withdrawn by said pinion which is rotated by the motor, and when said pinion is reversely rotated, said tongue base is released from said latched state, and said tongue base is pushed out of said buckle by said ejector, thereby separating said tongue from said buckle.

7. An automatic buckling device according to claim 1, wherein said buckle is provided at the forward end thereof with a sensor for detecting approach of said tongue and a solenoid which is excited in accordance with a detection signal of said sensor, and said tongue is provided on a forward end surface thereof with one of a metal plate an a magnet which is magnetically attracted to said solenoid.

* * * * *